United States Patent [19]

Lafitte

[11] Patent Number: 4,819,728

[45] Date of Patent: Apr. 11, 1989

[54] PRESSURE RELIEF SYSTEM FOR DOWN HOLE CHEMICAL CUTTERS

[76] Inventor: Louis D. Lafitte, 104 Marcel St., Houma, La. 70364

[21] Appl. No.: 92,087

[22] Filed: Sep. 1, 1987

[51] Int. Cl.[4] ..... E21B 29/02

[52] U.S. Cl. ..... 166/298; 166/55; 166/63

[58] Field of Search ..... 166/55, 63, 206, 212, 166/297, 298, 299, 373

[56] References Cited

U.S. PATENT DOCUMENTS

| | | | |
|---|---|---|---|
| 2,302,567 | 11/1942 | O'Neill | 166/55 |
| 2,918,125 | 12/1959 | Sweetman | 166/35 |
| 3,076,507 | 2/1963 | Sweetman | 166/35 |
| 3,211,093 | 10/1965 | McCullough | 102/20 |
| 4,125,161 | 11/1978 | Chammas | 166/297 |
| 4,158,389 | 6/1979 | Chammas et al. | 166/297 |
| 4,180,131 | 12/1979 | Chammas | 166/55 |
| 4,250,960 | 2/1981 | Chammas | 166/55 |
| 4,315,797 | 2/1982 | Peppers | 166/63 |
| 4,345,646 | 8/1982 | Terrell | 166/212 |
| 4,415,029 | 11/1983 | Pratt et al. | 166/212 |
| 4,494,601 | 6/1985 | Pratt et al. | 166/55 |
| 4,619,318 | 10/1986 | Terrell et al. | 166/55 |
| 4,620,591 | 11/1986 | Terrell et al. | 166/63 |

*Primary Examiner*—Jerome W. Massie
*Assistant Examiner*—Terry Lee Melius
*Attorney, Agent, or Firm*—C. Emmett Pugh

[57] ABSTRACT

An improvement in chemical cutting apparatus for use down within a well bore comprising an automatic means of pressure relief, whereby the anchoring mechanism of the apparatus is disengaged automatically when a clogging of the chemical discharge ports or other malfunction occurs, which pressure relief prevents the cutting tool from becoming stuck down in the hole. The automatic means includes a pressure relief port in the form of an axial bore from the exterior of the assembly to the anchor slip chamber, situated in such a manner that the inside pressure of the cutting apparatus does not communicate with the exterior, until the anchor slip becomes erect. The relief also includes an expendable plug and "O" ring assembly, which acts to prevent clogging of the relief port prior to firing of the cutting apparatus. The pressure relief is made small enough and is so located to prevent it from interfering with the normal operation of the cutting tool, but nonetheless is effective in relieving the built-up high internal pressure when the tool malfunctions.

5 Claims, 7 Drawing Sheets

PRESSURE RELIEF SYSTEM FOR DOWN HOLE CHEMICAL CUTTERS

BACKGROUND OF THE INVENTION

1. Field of the Invention

The present invention relates to an improvement in chemical cutting systems and more particularly to a new and unobvious pressure bleed-off system for an apparatus which chemically cuts objects down within a well bore to insure that the center does not get stuck down in the hole.

2. Prior Art & General Background

The most relevant prior art of which Applicant is aware may be found in U.S. Pat. No. 4,250,960 (Chammas, issued Feb. 13, 1981) and No. 4,620,591 (Terrell et al, issued Nov. 4, 1986); both of these patents teach a down hole chemical cutting system having pressure relief means distinguishable from the present invention and will be further discussed infra.

A list of prior patents which may be of interest are listed below:

| U.S. Pat. No. | Patentee(s) | Issue Date |
|---|---|---|
| 2,918,125 | Sweetman, W. | 12/22/1959 |
| 3,076,507 | Sweetman, W. | 02/05/1963 |
| 3,211,093 | McCullough | 10/12/1965 |
| 4,125,161 | Chammas | 11/14/1978 |
| 4,158,389 | Chammas et al. | 06/19/1979 |
| 4,180,131 | Chammas | 12/25/1979 |
| 4,250,960 | Chammas | 02/17/1981 |
| 4,315,797 | Peppers | 02/16/1982 |
| 4,415,029 | Pratt et al. | 11/15/1983 |
| 4,494,601 | Pratt et al. | 06/22/1985 |
| 4,619,318 | Terrell et al. | 10/28/1986 |
| 4,620,591 | Terrell et al. | 11/04/1986 |

As may be ascertained by the above listing of prior art, chemical cutters are well known, having been in use at least as early at 1959, when W. G. Sweetman invented one of the first practical downhole chemical cutting apparatus and methods.

These cutter devices are frequently used to cut, sever, perforate or slot an object down within a well bore. The cut object referred to above may include drill pipe, casing, or foreign objects which may become lodged in the well bore.

The above referenced cutter devices generally comprise tubular casings which contain a highly corrosive or oxidizing chemical cutting fluid. When the fluid is introduced to the desired discharge area, it reacts violently with it, totally oxidizing that portion of the area which the chemical contacts.

Thus, when the cutting fluid is properly introduced to the well bore, the chemical should effectively sever the drill pipe and/or casing. The most widely used chemical cutting fluids have been fluorine or halogen fluorides, including but not limited to chlorine monofluoride, chlorine trifluoride, bromine pentafluoride and other compounds.

The chemical cutting fluid is generally contained in a cylindrical containment/discharge vessel which is lowered within the bore to the desired discharge area. The fluid is then applied by utilizing a pressurizing agent, typically black gunpowder or the like, which causes a high pressure discharge.

The measure of the pressurizing agent, taking into consideration the amount of cutting fluid, the size of the discharge ports, and the hydrostatic pressure at the cutting depth, may be calculated in such a manner as to provide an accurate and effectively controlled means of introducing the cutting fluid to the desired area.

In addition to the above teachings, much of the prior art has also taught a means of securing the chemical cutting apparatus to the well bore during the discharge phase, locking the apparatus in place, thereby providing a more accurate application of the cutting fluid to the desired area.

The method has generally comprised the use of anchors or slips which are forced outward from the periphery of the cutting apparatus and against the well bore in response to the increased pressure generated by the pressurizing agent during discharge.

The internal pressure generated during the discharge phase is released through the chemical discharge ports, once the cutting fluid has been expelled.

After the discharge phase is complete and the excess internal pressure is dissipated, springs and/or the hydrostatic pressure of the well and/or other means cause the anchors or slips to retract to their closed position, disengaging the cutting apparatus from the well bore.

A frequent problem which has occurred over the last twenty to thirty years in this art arises when the chemical discharge ports become clogged before or during the cutting operation. Such an occurrence not only hinders or eliminates the proper discharge of the cutting fluid, it also prevents the internal pressure generated by the ignition of the pressurizing agent from being dissipated through the discharge ports, thus causing the anchors or slips to remain frozen in their fully erect or locking position.

A practical consequence of this malfunction is that the anchors or slips remain in an anchoring position against the well bore, making removal of the cutting apparatus difficult if not impossible. Another consequence is that the cutting apparatus becomes very dangerous to handle, and, even if the apparatus is able to be removed, it must somehow be manually vented, which might be impossible to safely accomplish, depending upon its design.

Thus, a longstanding need arose for a chemical cutting tool which included a means for venting or bleeding off excess pressure which remained due to a malfunction caused by a clogged or otherwise blocked discharge port.

As briefly cited supra, U.S. Pat. No. 4,620,591, issued Nov. 4, 1986 and No. 4,250,960, issued Feb. 17, 1981 attempted to fulfill the long felt need for such a pressure relief system. These, it is believed, are the only known prior teachings in this art which teach pressure venting or bleed-off means.

U.S. Pat. No. 4,250,960, entitled "Chemical Cutting Apparatus" teaches an improvement residing in a pressure relief subassembly situated between the pressure generation assembly and the chemical discharge assembly which comprises a valve mechanism for selective restriction of an aperture in the sub body, said mechanism allowing manual venting of the apparatus.

The operation of the system is more fully explained in the following quote, found under column 10 of the U.S. Pat. No. 4,250,960:

> "Upon retrieval of the tool from the well, and if the tool failed to operate for any reason such as the firing sub not functioning, pressure relief sub is vented first by opening the valve means by unscrewing the shem. Then, if the tool should fire accidentally during handling, substantial pressure would be vented through the aperture and out the opening. Thus, the pressure relief sub functions to greatly reduce the risk of injury to personnel."

Thus, the above pressure relief means requires total manual venting of the apparatus, which is not only exceedingly dangerous but may also prove impossible, if the device is anchored to the well bore. Therefore, said "improvement" does not attempt to fulfill the need for a safer and more effective downhole pressure relief means, which would allow the anchors or slips to disengage from the erect position, unfreezing the apparatus from the well bore.

U.S. Pat. No. 4,620,591 issued 1986 and entitled "Chemical Cutting Apparatus Having Selective Pressure Bleed-Off" attempts to fulfill the need for downhole pressure relief via a rather mechanically complicated, selective bleed-off subassembly.

U.S. Pat. No. 4,620,591 teaches a "selective" means of downhole venting, presumably to be used only in those cases where the apparatus actually becomes lodged downhole due to the clogging of the discharge port(s).

The patent utilizes two sub-assemblies comprising one sub and held together by two shear screws and locked in place by two steel balls which are configured in a retaining position prior to firing. Once the propellant or charge is ignited, the retaining balls are forced by the increased pressure into a position which allows the sub-assemblies to be slidably separated in the event of a misfire.

In the event of a misfire, the anchor slips would become lodged against the pipe wall, making removal of the device difficult, if not impossible. However, with the above patent, the relocation of the steel balls due to the firing of the propellant charge would allow the operator to selectively bleed-off the excessive pressure in the subs by pulling the wireline in an attempts to retrieve the device.

Sufficient upward pressure would act to shear two shear screws and cause the two sub-assemblies to telescope apart (as the retaining steel bolts have changed position due to the discharge of the propellant), allowing a bleed-off aperture to be exposed, thus venting the excessive pressure from the subs. At that point, the anchor slips would be forced back into their retracted position by the well's hydrostatic pressure. The apparatus would then be free to be pulled from the hole, with the excessive pressure drained and thus less hazardous to diffuse.

However, this system not only requires reassembly and changing of the shear bolts once it has been selectively vented, it also is mechanically rather complicated and thus should require more maintenance and have a substantially greater risk of failure than the relatively "fail safe" present invention discussed infra.

3. General Summary Discussion of the Invention

The present invention overcomes these prior art problems by providing a system which is highly reliable, relatively economical and very cost effective.

Although chemical cutting systems have been in use now for over thirty years, one of the first being invented by W. G. Sweetman sometime before 1955, the industry has, until now, been unsuccessful in perfecting a downhole pressure bleed-off system which is reliable, automatic, relatively maintenance free and cost effective.

Further, the present invention should provide a significant, substantial commercial impact with regard to the design and implementation of downhole chemical cutters due to the effectiveness of this system.

U.S. Pat. No. 4,620,591 appears to be the only prior art which teaches a means of downhole pressure relief in the event of a malfunction but, as discussed supra, it teaches a rather expensive, complicated, and potentially unreliable means when compared to the present invention. The present invention fulfills a long felt need which the industry has strived for since the invention of the chemical cutter, as will be shown infra.

The present invention comprises in its preferred embodiment the implementation of a pressure relief port in the anchor or slip sub-assembly, located between the propellant and chemical cutting fluid vessel assemblies, said relief port being for example one eighth ($\frac{1}{8}$) of an inch in diameter as used with for example the standard size 1 11/16 chemical cutter assembly (but varying in size depending upon the size of the assembly) in conjunction with an expendable plug, sealant, and "O" ring seal configuration.

When the cutter is fired the pressure from within the sub pushes the anchor slips out, said pressure then communicating with the pressure relief port. The pressure then pushes the expendable plug out of the relief plug chamber, thereby allowing venting to begin. Even though venting has begun, the size of the relief port is such that the internal pressure remains high enough to satisfactorily convey the cutting fluid through the chemical discharge port(s).

If the chemical discharge ports become clogged to such a degree as to prevent discharge of the cutter, the pressure would ultimately vent through the relief port, thereby allowing the hydrostatic pressure of the well to push the anchor slips into the retracted position, thus "freeing" the apparatus.

Without this venting effect, the cutter could either explode due to the tremendous amount of internal pressure generated during the firing of the propellant or the anchor slips would remain frozen in a fully erect position, preventing removal of the apparatus from the well bore. The present invention solves the problems associated with the above scenario in the most uncomplicated, reliable, and cost effective means to date.

The pressure generated by the firing of the propellant in the exemplary embodiment is approximately 3500 PSI. As only 1500 PSI is required to rupture the containment membrane of the chemical sub-assembly, there is more than enough pressure to complete the cutting operation even with the utilization of the relief port.

Further, the relief ports positioning in the anchor slip chamber is such that the pressure does not communicate with the relief port until the anchor slip has erected into its locking position. This is because the erection of the anchor slip occurs simultaneously with the application of the chemical cutting agent.

Thus, the loss of pressure from the use of the relief port is negligable and does not affect the performance of the cutter. Numerous experamental test cuttings in the field verify that the implimentation of the design as taught in the exemplary embodiment of the present invention works consistantly and in a much superior manner than the prior teachings.

Further, the numerous field test cuttings also verify that this is by far the most efficient, least troublesome, and most reliable cutting system to date, with none of the failures associated with the prior art.

It is thus an object of the present invention to provide an improved chemical cutting apparatus for utilization within a well bore.

It is another object of the present invention to provide an improved cutting apparatus for utilization within a well bore, which permits pressure within the tool to be automatically vented.

It is another object of the present invention to provide a safe, reliable, and cost effective means for automatic pressure venting without affecting the cutting effectiveness of the cutters.

It is yet another object of the present invention to provide a safe, reliable, and cost effective means for automatic pressure venting which could be adopted for use with many of the present cutting systems on the market.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENT(S)

Figure 1:
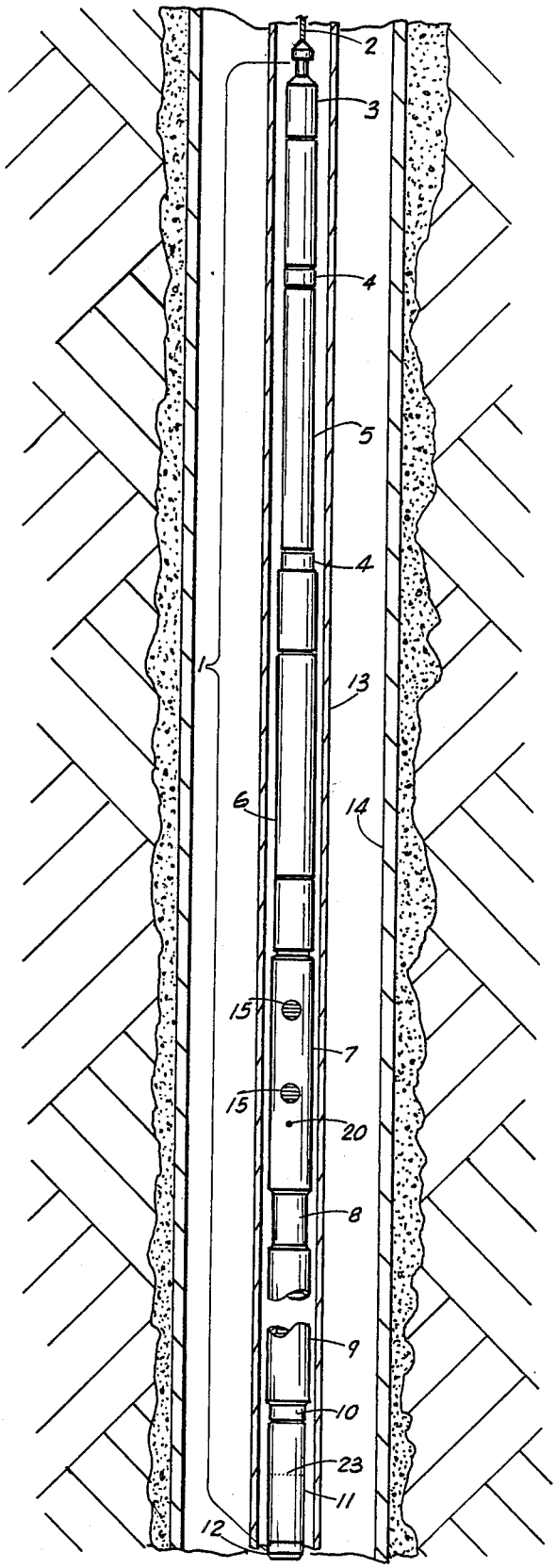
FIG. 1 is a side view of the preferred embodiment of the novel chemical cutting apparatus of the present invention and its relation to its down hole operating environment.
Figure 2:
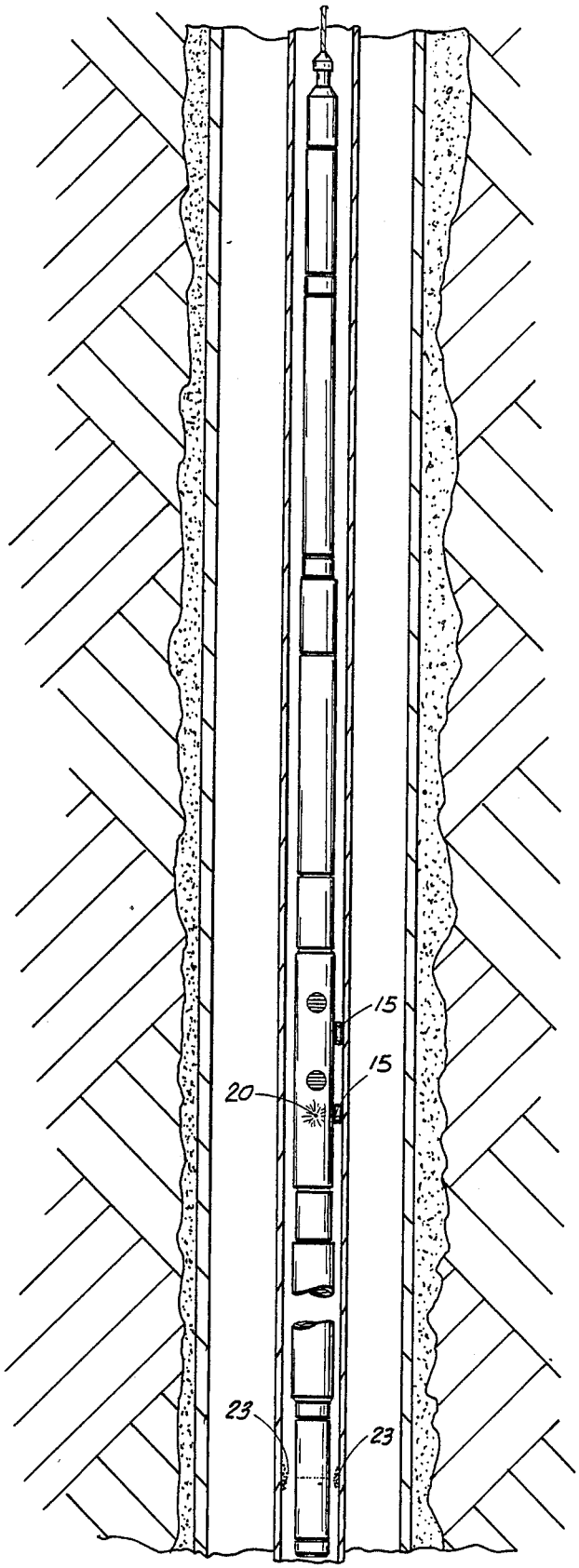
FIG. 2 is a side view of the preferred embodiment of the novel chemical cutting apparatus of the present invention illustrating proper operation of the system, and, in particular, the discharge of the chemical cutting fluid in conjunction with the operation of the relief port as taught in the present invention.
Figure 3:
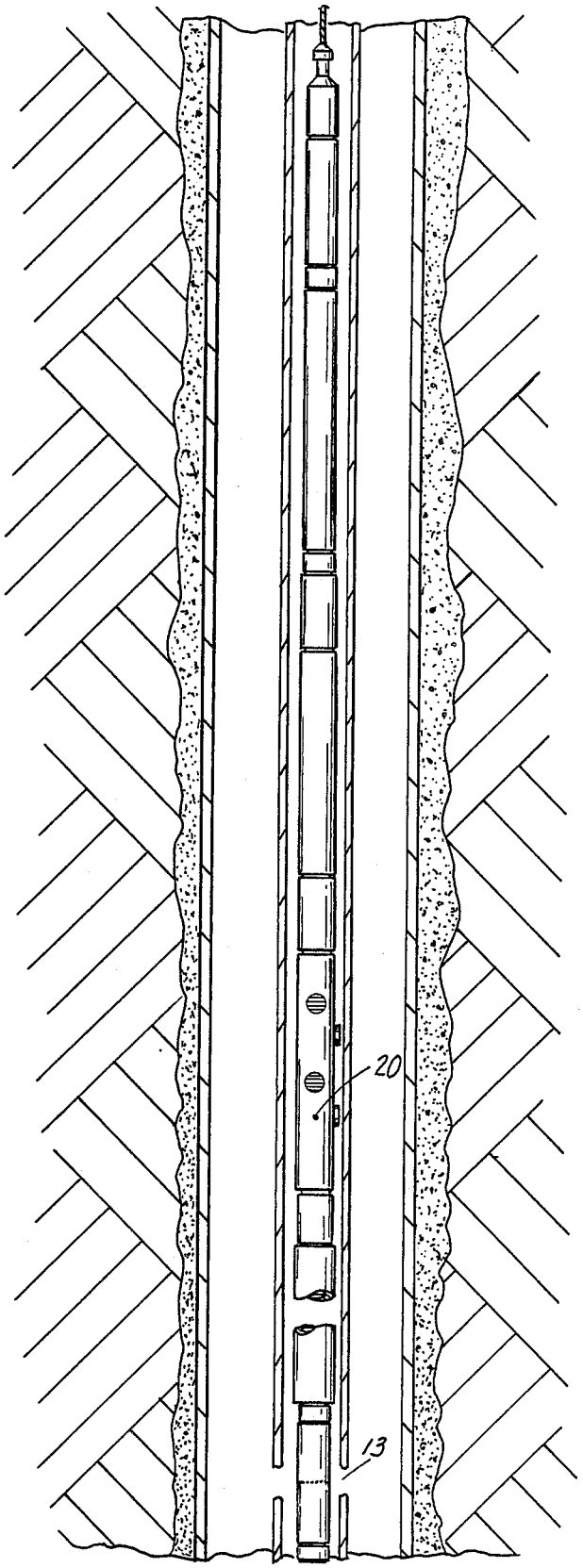
FIG. 3 is a side view of the preferred embodiment of the novel chemical cutting apparatus of the present invention illustrating the system once discharge is complete, with the resulting, desired drill pipe cut.
Figure 4:
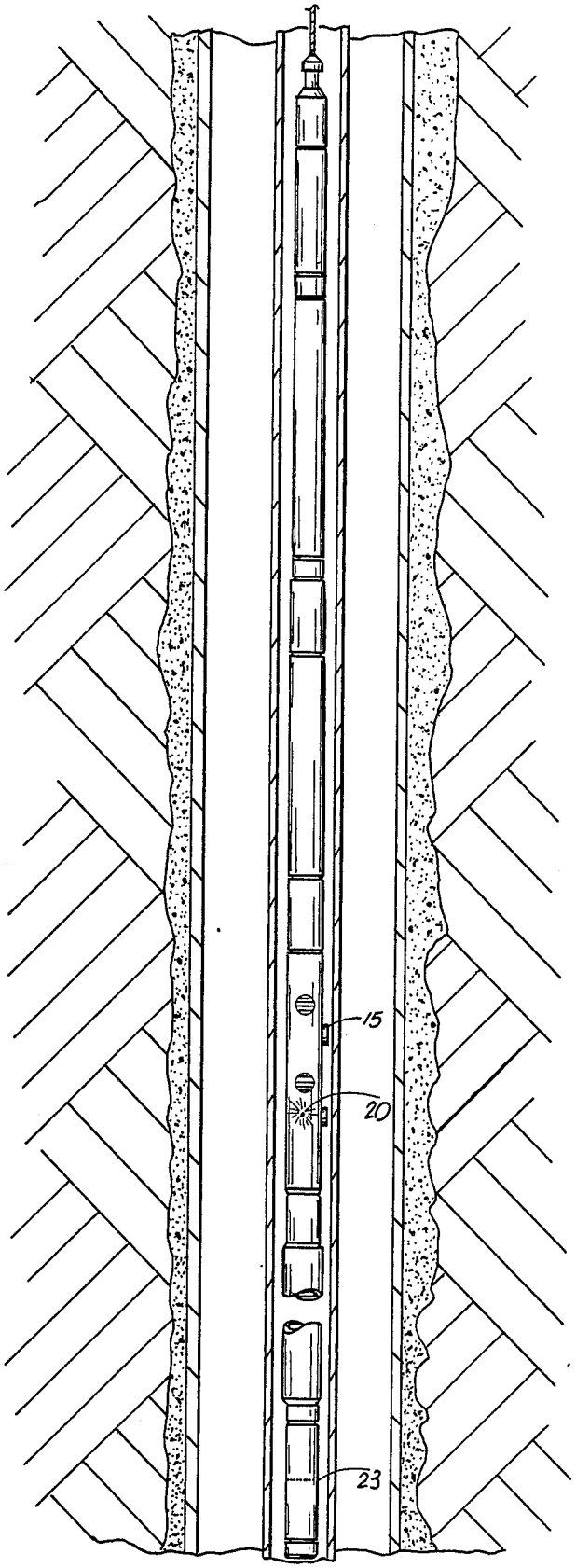
FIG. 4 is a side view of the preferred embodiment of the novel chemical cutting apparatus of the present invention illustrating the operation of the pressure relief port, and the resulting retraction of the anchor slips.

As can be seen in FIG. 1, the general operation of the preferred, exemplary embodiment of the chemical cutter 1 of the present invention includes an array of subassemblies, each assembly performing certain functions, the entire apparatus being lowered down hole into the well bore within the drill pipe or tubing 13 to the desired cutting depth via a line 2 fixedly attached to the system by a rope socket subassembly 3.

The rope socket subassembly 3 is threadingly connected to a crossover sub 4, which acts to threadingly attach assembly 3 to another subassembly.

In the FIG. 1 example, the collar locator 5 follows the first crossover sub 4. The collar locator 5 contains an electronic device, which detects the collars of the drill pipe or other tubing, allowing accurate calculation of the cutting depth for the cutting system 1.

Following the second crossover sub 4 is the propellant charge assembly 6, which contains the high pressure discharge system. The discharge system is fired by command from the wireline operator via communication by electronic or hydraulic means through line 2 to the assembly 6. When the system is fired, the pressurizing agent causes greatly increased pressure within assembly 6, causing said pressure to move into hold down sub assembly 7.

Subassembly 7 contains the anchor slips or holding dogs 15 and the relief port, comprising relief plug chamber 20 and the bleed off orifice 28. When the excess pressure from the pressurizing agent reaches assembly 7, the holding dogs 15 are forced from their retracted position and erected, until they contact the walls of the drill pipe or tubing 13, holding the cutting system 1 in place.

Once the pressure has erected the anchor slips or holding dogs 15, the pressure passes through pressure choke sub 8, which in turn is connectedly affixed to chemical cylinder 9, the vessel which contains the chemical cutting fluid. The pressure ruptures a containment membrane in assembly 9, forcing the cutting fluid through the catalyst or ignition chamber 10.

When the cutting fluid contacts the catalyst contained in the ignition chamber 10, the chemical becomes highly volatile and is thereby ready to contact the surface to be oxidized. The catalyst may, for example, consist of lightly oiled steel wool.

The catalyzed cutting fluid then passes into the threadingly affixed cutter head assembly 11, where the cutting fluid is ultimately discharged through chemical discharge ports 23 onto the desired surface to be oxidized, generally drill pipe or tubing 13. Bull plug assembly 12 plugs the end of the system.

Figure 5:
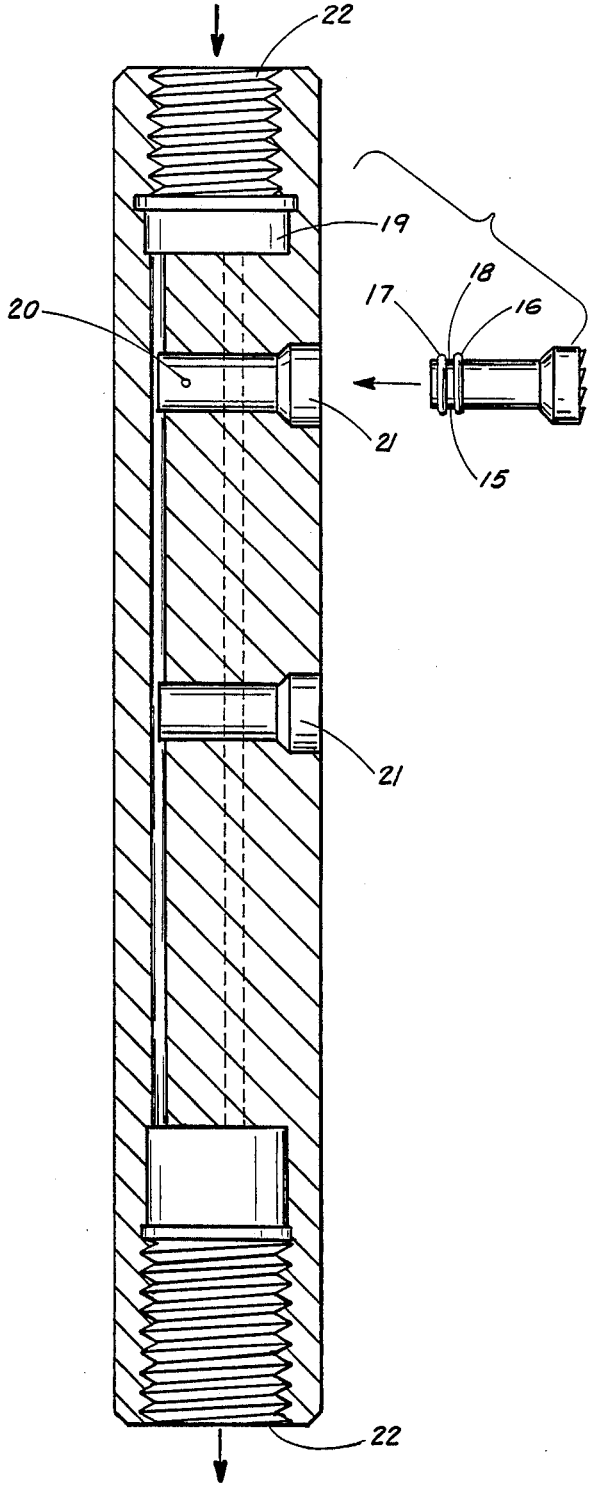
FIG. 5 is a side, cross-sectional, detail view of the preferred embodiment of the present invention, illustrating the location of the pressure relief port in relation to the anchor slips or "holding dogs" and the general configuration of the anchor or hold down subassembly.
Figure 8:
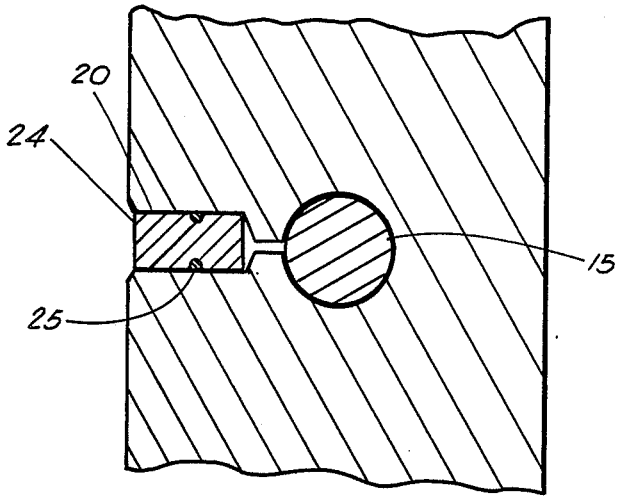
FIG. 8 is a side, cross-sectional view of the present invention, illustrating the relation of the relief port and expendable plug and "O" ring assembly in conjunction with the anchor slip or "holding dog".

As can better be seen in FIGS. 5 and 8, the preferred embodiment of the present invention comprises a pressure relief port 20, 28, situated in such a manner as to ultimately vent one of the holding dog 15 chambers 21 of the hold down sub assembly 7.

The relief port 20,28 comprises an exterior, expendable plug chamber with an approximate exemplary diameter of just over ¼ of an inch 20, which slidably contains an expendable (exemplary ¼ inch) brass plug 24 and "O" ring 25. The plug 24 and "O" ring 25 are slidably placed into the chamber 20 using a petroleum product for lubrication and sealing, for example, "Never Seize" lubricant. The plug 24 functions to prevent debris from the well bore from contaminating or plugging the relief port 20.

Connected to and communicating with the quarter inch relief port 20 is the bleed off orifice 28 with an exemplary size of one eight of an inch. Port 28 is situated in such a manner as to provide pressure relief via the anchor slip chamber 21, so that orifice 28 is isolated intermediate to the "O" rings 16, 17 when the holding dog 15 is in its fully retracted position.

The effect of the strategic positioning of the bleed off port 28 is such that the venting only occurs when the dogs 15 are in their erect and locking position due to the increased pressure in the propellant discharge and cutting sequence.

When the propellant is ignited, the resulting gas erects anchor slip 15 from the periphery of the assembly 17. As the dogs are forced into their erect position, pressure is allowed to enter the one eighth inch bleed off orifice, permitting further communication with the quarter inch pressure relief plug chamber 20. The pressure then pushes the expendable brass plug 24 and "O" ring 25 out of the relief plug chamber 20, allowing gradual venting of the system should a malfunction occur.

The pressure relief caused by the operation of the relief port 20,28 during the cutting operation is comparatively minuscule and does not affect the operation of the system. The relief port 20,28, however, does provide effective bleed off over time in those situations where the chemical discharge ports have become clogged and the anchor slips 15 freeze in the locked position due to pressure trapped inside the apparatus 1.

In these situations, the continuous venting of relief port 20,28 is sufficient to cause pressure equilibrium to be reached between the internal system pressure and that of the well bore. The excess pressure from within apparatus 1 is released through the relief port, and the hydrostatic pressure of the well bore can thereby cause the anchor slips 15 to retract to their closed position, allowing easy retrieval of the apparatus 1 from the well bore.

Figure 6:
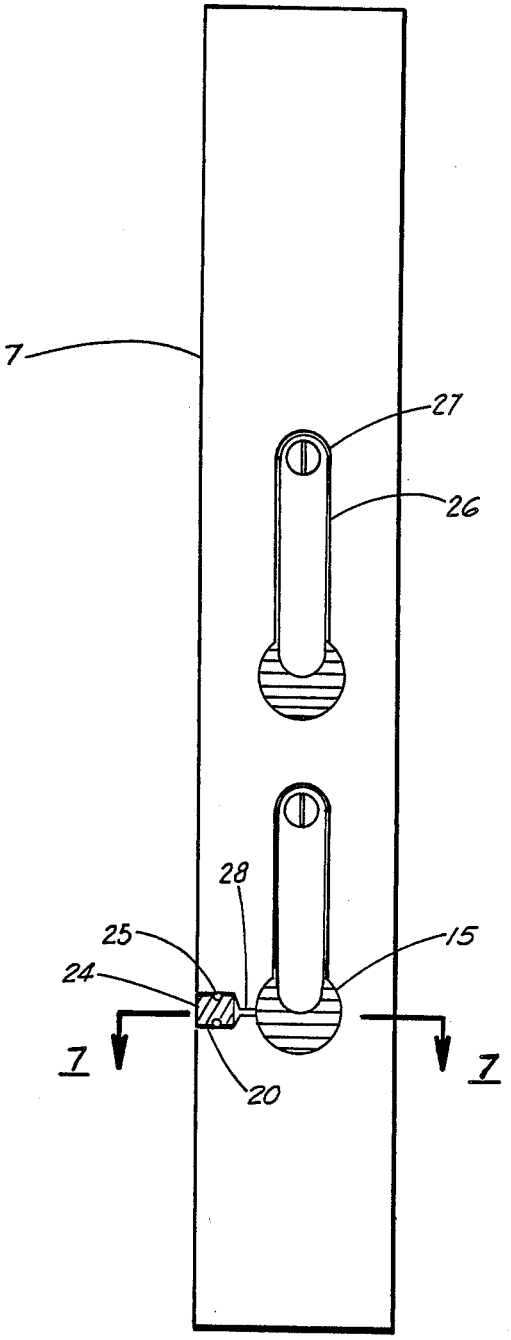
FIG. 6 is a side, partially cross-sectional view of the preferred embodiment of the present invention, further illustrating the exemplary pressure relief port, comprising a ¼ inch O.D. relief plug chamber and ⅛ bleed off port, allowing communication with the anchor slip chamber and the ¼ inch relief plug chamber, with the exemplary quarter (¼) inch expendable brass plug and "O" ring assembly inserted therein.
Figure 7:
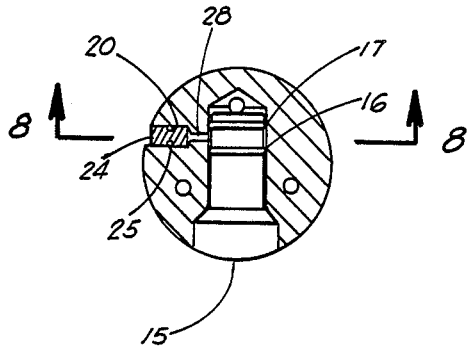
FIG. 7 is a top, cross-sectional view of the preferred embodiment of the present invention, illustrating the anchor slip and its relation to the relief port, in which the expendable plug and "O" ring assembly is placed.

In addition to the use of hydrostatic pressure for retraction, the present invention teaches the implementation of flat, hard metal springs 26, which aid in the retraction of the dogs, once the venting is complete or the cutting sequence has taken place. The springs 26 are attached to the hold down sub assembly 7 via screws 27, the actual placement of which may be viewed in FIG. 6.

The foregoing represents a detailed exemplary embodiment for one exemplary size of chemical cutter. However, it should be understood that the size and positioning of the relief port 20,28 is subject to substantial variation with in the inventive concepts herein disclosed. On the other hand the relative size and positioning of the pressure relief port 20, 28 should be relatively small in comparison to the rest of the apparatus and be positioned, so that it does not significantly effect the normal operation of the cutting tool when it is activated, but nonetheless is effective in preventing the tool from becoming stuck down in the hold when the tool malfunctions and the pressure would otherwise be trapped within the tool, causing it to become stuck down hole.

Thus the embodiment(s) described herein in detail for exemplary purposes are of course subject to many different variations in structure, design and application. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. An apparatus for cutting an object within an earth bore in a desired application area, comprising a generally elongated, cylindrical structure which includes:

(a) suspension means for suspending the apparatus within the earth bore;

(b) gas generation means for generating gas under pressure when ignited;

(c) firing means associated with said generation means for ignition of said gas generation means for generating the gas under pressure;

(d) a chamber, and movable anchor means in said chamber associated with and activated by pressure produced by said gas generation means for maintaining the apparatus in a substantially axial position in relation to the earth bore during the cutting operation;

(e) chemical releasing means for releasing a chemical cutting agent contained within the apparatus to the earth bore;

(f) discharge means for discharging a chemical cutting agent utilizing said gas generation means via said releasing means to the desired application area; and (g) pressure relief means for pressure relief intermediate said gas generation means and said chemical releasing and located within said chamber of said anchor means for providing automatic means of pressure relief in the event that the cutting apparatus malfunctions, facilitating retraction of said anchor means and allowing the malfunctioned apparatus to be removed from the hole.

2. The apparatus of claim 1, wherein said pressure relief means is positioned between said gas generation means and said anchor means.

3. The apparatus of claim 1, wherein said pressure relief means comprises:

(i) a body located intermediate said gas generation means and said chemical releasing means, said body having an axial bore therethrough and at least one aperture, (ii) said pressure relief means allowing pressure communication between said gas generating means and said axial bore when said anchoring means moves into the anchoring position, (iii) said aperture providing pressure communication between said axial bore and said exterior of said assembly when said anchor means moves into the anchoring position, and (iv) delay means for delaying communication of said gas generating means from within said chamber to the exterior of said apparatus pending ignition of said firing means.

4. The apparatus of claim 2, wherein said delay means comprising:

a plug;

a pressure seal associated with said plug; and lubricant means placed on said delay means for better facilitating its placement and operation.

5. A method for substantially diminishing the chances that a down hole chemical cutter, having an anchoring subassembly with gas generation means and chemical releasing means, will get struck in an earth bore due to the freezing of the internal pressure used for discharging the cutting chemical, said method comprising the following step:

implementing a downhole chemical cutter having means of pressure relief in the form of a pressure relief port in the side of the anchoring subassembly located intermediate said gas generation means and said chemical releasing means, sized and situated to avoid any significant interference with the normal operation of said chemical cutter but being effective in automatically releasing the high internal pressure which otherwise would exist and could cause the tool to become stuck down in the hole without the pressure relief port, said anchoring subassembly including a chamber and movable anchor means in said chamber;

lowering the chemical cutter into the hole to the designated area to be cut;

firing said gas generation means;

allowing the increased pressure associated with said gas generation means to move said anchor means into anchoring position;

allowing the increased pressure to begin venting from said chamber of said anchor means into the bore via said pressure relief port; and allowing said pressure relief port to continue to vent until all of the increased pressure associated with the gas generation means is vented.

* * * * *